US005131324A

United States Patent [19]

Lassila et al.

[11] Patent Number: 5,131,324

[45] Date of Patent: Jul. 21, 1992

[54] CALENDER DEVICE FOR ON-LINE CONNECTION TO A PAPER MACHINE

[75] Inventors: Ari Lassila; Kari Sipi, both of Espoo, Finland

[73] Assignee: Valmet Paper Machinery Inc., Helsinki, Finland

[21] Appl. No.: 618,716

[22] Filed: Nov. 27, 1990

[30] Foreign Application Priority Data

Nov. 27, 1989 [FI] Finland ..... 895673

[51] Int. Cl.[5] ..... D21G 1/00; B30B 3/04

[52] U.S. Cl. ..... 100/153; 100/162 B; 100/163 R; 100/166; 100/173

[58] Field of Search ..... 100/153, 161, 162 R, 100/162 B, 163 R, 166, 167, 170, 173, 174

[56] References Cited

U.S. PATENT DOCUMENTS

| | | | |
|---|---|---|---|
| 3,194,151 | 7/1965 | Nelson | 100/173 X |
| 3,254,593 | 6/1966 | Beachler | 100/162 R X |
| 4,194,446 | 3/1980 | Palovaara | 100/170 X |
| 4,211,165 | 7/1980 | Schill | 100/162 R |
| 4,332,191 | 6/1982 | Kankaanpaa | 100/162 R |
| 4,375,188 | 3/1983 | Leiviskä | 100/162 R |
| 4,471,690 | 9/1984 | Yamaguchi et al. | 100/162 R |
| 4,915,026 | 4/1990 | Halme | 100/162 R |
| 4,960,046 | 10/1990 | Anstötz et al. | 100/162 R X |

FOREIGN PATENT DOCUMENTS

| | | | |
|---|---|---|---|
| 598876 | 6/1934 | Fed. Rep. of Germany | 100/162 R |
| 610695 | 3/1935 | Fed. Rep. of Germany | 100/162 R |
| 794581 | 2/1936 | France | 100/162 R |
| 2588293 | 4/1987 | France | 100/162 R |
| 829755 | 5/1981 | U.S.S.R. | 100/161 |
| 463165 | 3/1937 | United Kingdom | 100/162 R |

*Primary Examiner*—Harvey C. Hornsby
*Assistant Examiner*—Stephen F. Gerrity
*Attorney, Agent, or Firm*—Cohen, Pontani, Lieberman & Pavane

[57] ABSTRACT

An on-machine calender device intended to be on-line connected to a paper machine. The calender comprises a number of subsequent calendering nips, through which the web (W) to be calendered can be passed. The nips are formed between a soft calender roll and a hard calender roll or between two soft calender rolls. The calender is composed of one or several, for example two, subsequent calender modules ($M_1$, $M_2$). The modules comprise one counter-roll (10, 20) and at least two soft calendering rolls (11, 12, 13; 21, 22, 23), which are placed at both sides of the counter-roll (10, 20) in the direction of running of the web (W). The calender rolls (10, 11, 12, 13;20, 21, 22, 23) are dispaceable in relation to each other so that the threading of the web (W) can be carried out as a straight run, for which purpose an open passage is opened through the calender.

21 Claims, 3 Drawing Sheets

CALENDER DEVICE FOR ON-LINE CONNECTION TO A PAPER MACHINE

FIELD OF THE INVENTION

The invention concerns an on-machine calender intended to be on-line connected to a paper machine or to a paper coating machine, and in particular a so-called "soft calender", which comprises a number of sequential calendering nips through which the web to be calendered can be passed, said nips being formed between a soft calender roll and a hard calender roll or between two soft calender rolls. The instant calender comprises one or several calender modules, most appropriately of two subsequent calender modules, which comprise one counter-roll and at least two soft calendering rolls, and which are placed at both sides of said counter-roll in the direction of running of the web.

BACKGROUND OF THE INVENTION

A paper or web coming out of a paper machine has rough surfaces, which require finishing for most purposes of use. For finishing, smoothing devices (e.g. machine calenders) and resilient-nip calenders (e.g. soft or supercalenders) are known in the art and the smoothing devices comprise hard rolls only, and smooth the paper surfaces substantially in one plane. The nips in a resilient-nip calender are called soft nips since a hard roll forms a pair with an elastically resilient roll. In a resilient-nip calender, the elastically resilient rolls are, as a rule, paper rolls, whose surface layer consists of paper rings fitted as layers one above the other. A resilient-nip calender also contributes to smoothing to a certain extent, but, primarily serves to impart a glaze, i.e. the surface of the paper web is compacted and closed.

Instead of softcalendering, the term "matt calendering" can be used. A supercalender is an off-machine device, whereas a soft calender is an on-machine or on-line device (as a rule having 1 or 2 nips) or an off-machine device (having up to 4 nips). In soft calenders the resilient rolls are not paper rolls, as they are in supercalenders, but they are different types of polymer or equivalent rolls, whose own internal generation of heat is lower than in paper rolls and whose sensitivity to surface damage is lower. As a rule, softcalendering is calendering that is carried out as an on-line operation while making use of high temperatures (clearly higher than the temperatures in a supercalender) with a minimum number of nips. Currently, a soft calender is used extensively instead of a machine calender with matt qualities as well as with coated papers in connection with a paper or coating machine when either the running speeds are low, the machines are narrow, and/or the linear loads and/or temperatures employed are not among the highest. As a rule, high-gloss papers continue to be calendered by means of a supercalender.

On-line operation of a calender imposes particular requirements on the calender as compared with separate supercalenders. The most important requirement is that a minimal proportion of the paper becomes "broke" because of particular operations and disturbance in the calender. One such operation is the threading of the web. Most disturbances in operation result from damage to rolls, in particular to soft rolls, and from standstills caused by such damage.

At present, soft calendering is mainly used as a substitute for machine calendering only. For calendering of qualities of higher gloss, the present roll materials are not sufficiently durable for on-line calendering, i.e. with two nips at the speed for a paper or coating machine. Since the roll materials do not withstand the conditions under which a quality product can be achieved, one means of achieving a quality product is to increase the number of nips. If attempts are made in the future, to substitute for the supercalender, tests that have been carried out indicate that by means of fewer than four nips, with the present-day running speeds, do not result in the supercalendering quality needed for present bulk qualities, such as SC- and LWC-papers. Efficient SC- and LWC-machines are wide high-speed machines (<1400 m/min), requiring a simple threading of the web free of disturbances. In the prior art, soft calenders that are on-line connected to a paper machine consist of units subsequent to the machine that comprise a soft calender roll and a hard calender roll, a necessary number of such units being placed one after the other so that the web to be processed runs substantially horizontal. In these calenders the threading of the web is relatively easy and free of disturbance, because the subsequent nips can be opened and the end of the web can be passed through the calender as a substantially horizontal straight run. It is a drawback of said calender that the calender takes quite a large space in the direction of running of the web, which increases the cost of the machine hall.

It is a further drawback that the embodiment of the calender with separate frames becomes quite expensive.

In the prior art, on-line calenders are also known in which there are calender modules consisting of three calender rolls placed one above the other. In these modules, the middle roll is a hard roll and soft rolls are placed at both sides of the hard roll, so that in each module two calender nips are formed, placed one above the other. Said hard roll is journalled as fixed in the calender roll, and the soft rolls are displaceably arranged and supported by loading arms for the opening, relieving and loading of the nips. Since in an on-line calender more than two nips are needed, in said construction a three-roll module of the sort described is provided at each side of the vertical frame of the calender. The construction of said on-line calender is relatively compact and takes little space, but it involves the problem of difficulties in threading through a great number of curves as well as of the standstills resulting from breakdowns of the soft rolls which are sensitive to damage.

As was stated above on-line soft calenders have, as a rule, comprised 1 or 2 nips only, because in on-machine operation, with a higher number of nips and with prior-art solutions, the threading of the web has caused difficulties for which the prior-art calenders have not provided solutions. Even though, above and below, for the sake of conciseness, on-line calenders of paper machines have been described, it should be emphasized that the scope of the invention also includes on-line calenders of paper coating machines and of corresponding paper finishing machines separate from paper machines, in which calenders with substantially the same problems and needs for development occur as in said calenders of paper machines.

An object of the present invention is to avoid the drawbacks described above and to provide such an on-line calender which takes relatively little space in the machine direction, so that the calender can be accommodated in the usually limited space that is available, for example, when a machine calender is being modernized.

Another important object of the invention is to provide an on-line calender wherein the threading is free of disturbance and free of problems, the objective being that the threading should take a minimum of time during which the paper broke coming out of the paper machine or finishing machine is passed.

It is a further object of the invention to provide a calender construction whose cost of manufacture is favorable and in which, it is possible to use calender modules of more or less standard construction, by which modules it is thus possible to assemble different on-line calenders that have a sufficiently high number of calendering nips in compliance with the requirements imposed by the product.

SUMMARY OF THE INVENTION

In view of achieving the objectives stated above and those that will come out below, in the instant invention calender rolls are arranged to be displaceable in relation to each other so that the threading of the web can be carried out substantially as a straight run, for which purpose an passage through the calender is opened.

In the calender in accordance with the invention, the threading of the web must be carried out through a straight free space through open nips. The rolls that are displaced when the nips are being opened may be either the hard roll and/or the soft rolls, and the construction of a calender module and the number of the subsequent calender modules are determined in accordance with the calendering requirement of the product. In one module, only one side of the web is calendered, for the treatment of a two-sided web at least two subsequent modules are needed, in which modules the rolls to be displaced are preferably at different sides of the web to be calendered.

A calender module for use in the invention consists of two or three softmantle press rolls, their counter-roll, and, if necessary, a lead roll or lead rolls, which keep the web apart from the hard roll in the area between the nips. Preferably, the lead roll moves along with the hard roll when the hard roll is being displaced.

Thus, in a calender module of the invention, the rolls to be loaded can be either above and/or below the web. The locations of the soft rolls in relation to the hard roll may vary; the rolls are at both sides of the hard roll, or the soft rolls are almost in contact with each other. The locations of the soft rolls may be either symmetric or asymmetric in relation to the hard roll.

If necessary, a belt may be arranged revolving around the soft rolls, the function of said belt being to protect the soft rolls from excessive heating and wear, and when roll materials are developed, said belt may also be heated to increase the efficiency of the process.

The rolls that form a calender module may be of any suitable type whatsoever, such as variable-crown rolls, heated or unheated rolls. The number of calender modules may be one, or two placed one after the other or, in special cases, even a higher number.

Direct threading of the web is possible, because the roll(s) displaceable for opening of the nip is/are shifted so far apart that the web can be passed straight through the opened nips. At the stage of closing of the nips, the roll(s) that permit(s) direct threading push(es) the web into contact or almost into contact with the counter-roll(s), and, depending on the embodiment, the loading itself takes place by means of the displaceable roll(s) and/or by means of the counter-roll(s).

BRIEF DESCRIPTION OF THE DRAWINGS

The invention will be described in detail with reference to some exemplifying embodiments of the invention illustrated in the figures in the accompanying drawings. It is understood that the invention is not confined to the detailed of said embodiments.

IN THE DRAWINGS

Figure 1A:
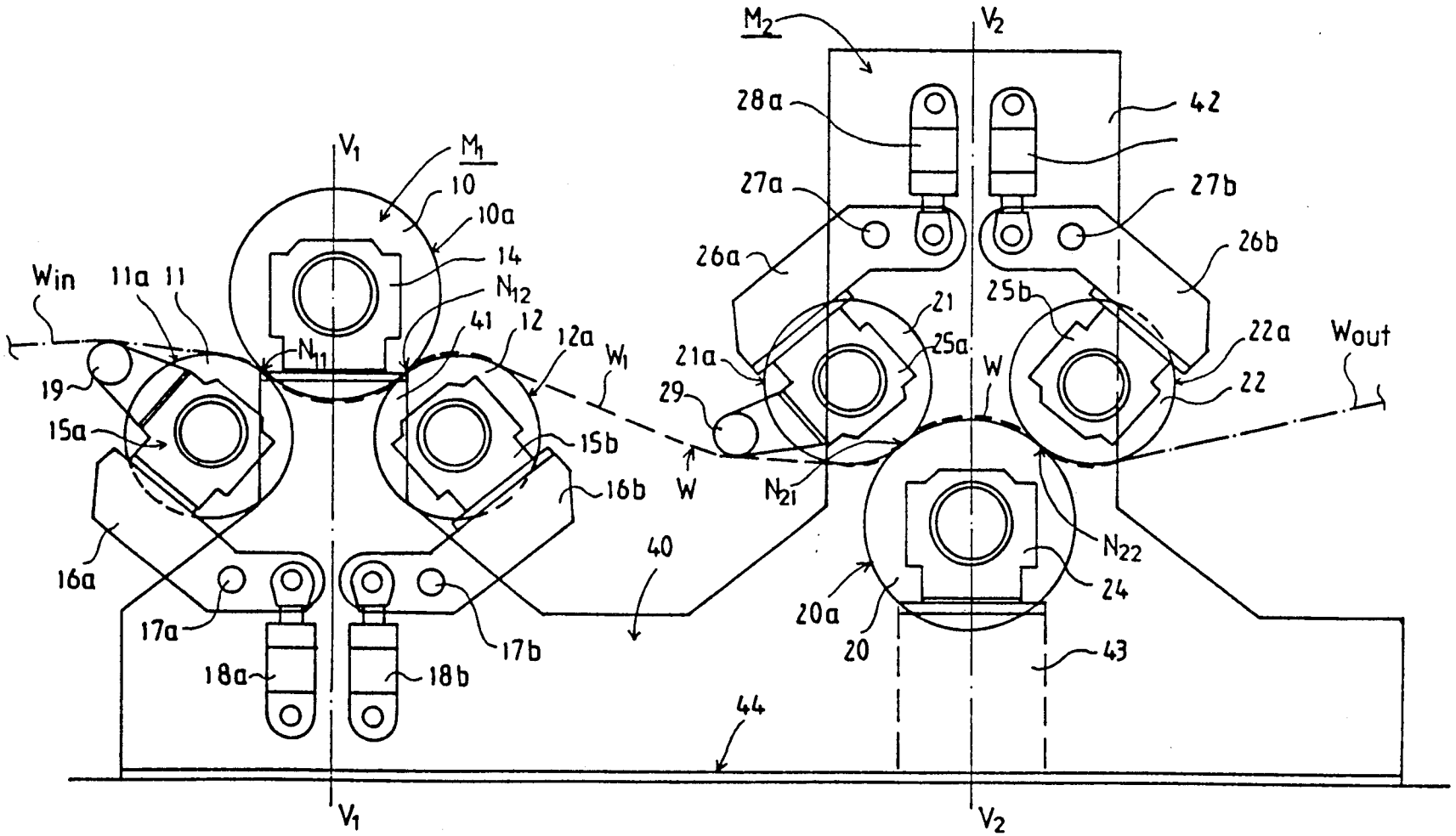

FIG. 1A shows a preferred embodiment of the invention wherein two subsequent three-roll calender modules are used, the nips being closed in the calendering position.

Figure 1B:
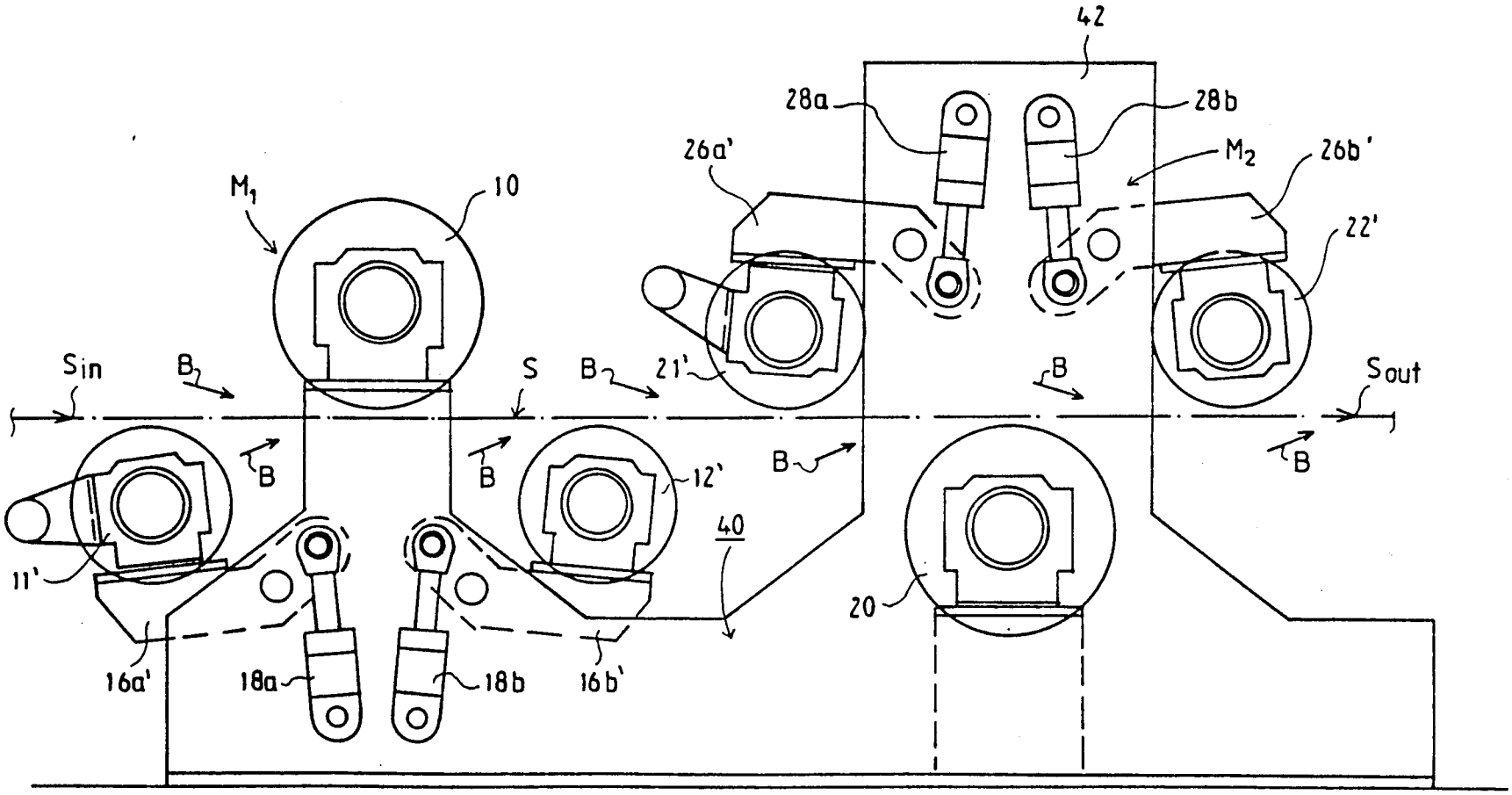

FIG. 1B shows the same as FIG. 1A with the nips opened to the threading position.

Figure 2:
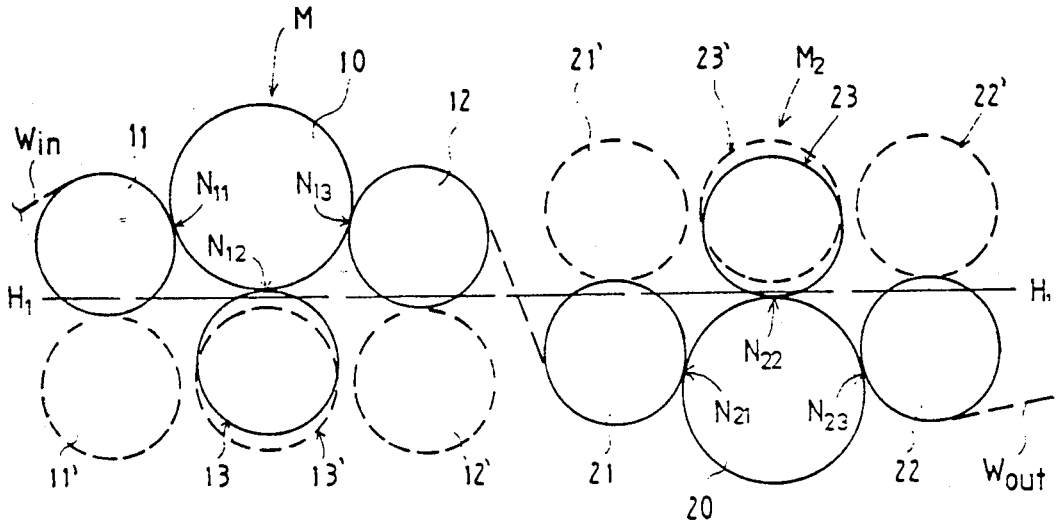

FIG. 2 shows a second version of the invention, wherein two subsequent fourroll calender modules are used, the dashed lines illustrating the soft rolls in their opened threading positions.

Figure 3:
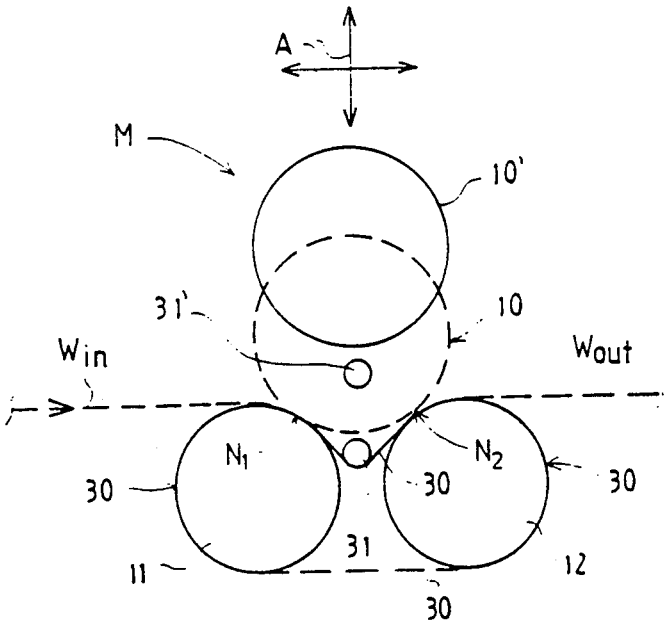

FIG. 3 shows a calender module in accordance with the invention wherein stationary soft rolls are fitted as lower rolls and a displaceable hard roll is fitted as an upper roll.

DETAILED DESCRIPTION OF THE PREFERRED EMBODIMENT

The on-line soft calender shown in FIGS. 1A and 1B comprises two three-roll calender modules $M_1$ and $M_2$, which are placed one after the other in the same horizontal plane. Each calender module $M_1$,$M_2$ comprises two calendering nips $N_{11}$,$N_{12}$ and $N_{21}$,$N_{22}$, which are respectively formed between a hard calender roll 10 and 20 and two soft calender rolls 11,12 and 21,22. The hard rolls 10 and 20 are, for example, steel rolls and have a respective hard polished face 10*a*,20*a*. The soft rolls 11,12;21,22 are calender rolls in themselves known, provided with a relatively resilient coating 11*a*,12*a*;21*a*,22*a* respectively.

As is shown in FIGS. 1A and 1B, the constructions of both of the calender modules $M_1$ and $M_2$ are substantially symmetric in relation to the vertical plane $V_1$–$V_1$ and $V_2$–$V_2$ passed through the axis of rotation of the hard roll 10,20. In the other respects, the constructions of the modules $M_1$ and $M_2$ are in such a way inverted in relation to each other that in the first module $M_1$ the hard roll 10 is the upper roll and in the latter module $M_2$ the hard roll 20 is the lower roll. The inverted construction has the effect that both sides of the web W to be calendered are treated symmetrically. The first hard roll 10 is mounted in connection with the calender frame 40 by means of bearing supports 14. The second hard roll 20 is mounted on the frame part 43 by means of bearing supports 24, said frame part 43 being supported on the calender frame 40 and possibly on the foundation construction 44.

As is shown in FIGS. 1A and 1B, the soft calender rolls 11,12 and 21,22 are mounted on bearing supports 15*a*,15*b* and 25*a*,25*b* respectively, which are supported on loading and support arms 16*a*,16*b* and 26*a*,26*b*. Said arms are connected to the frame part 40 of the calender by means of journals 17*a*,17*b* and 27*a*,27*b* respectively, the latter ones in connection with the vertical part 42 of the frame 40. The ends of the arms 16*a*,16*b* and 26*a*,26*b*, which are placed one opposite the other, are connected to the piston rods of the work cylinders 18*a*,18*b* and 28*a*,28*b* respectively, so that all the calendering nips can be loaded, relieved and opened to the threading position shown in FIG. 1B.

FIG. 1A shows the mode of operation of the calender in which the paper web $W_{in}$ coming on-line from the paper machine is passed over the guide roll 19 into the first nip $N_{11}$, thereupon, supported by the face 10*a* of the hard upper roll 10, into the second nip $N_{12}$, whereupon the web W runs over the face 12*a* of the roll 12. From the roll 12 a free run $W_1$ of the web W starts, after which, being guided by the guide roll 29, the web passes into the first nip $N_{21}$ in the second calender module $M_2$, thereupon, being guided by the mantle 20*a* of the hard lower roll, into the second nip $N_{22}$ in the second module $M_2$. From the roll 22 the web W departs from the calender in the direction of the arrow $W_{out}$, e.g., to the reel-up (not shown).

The first guide roll 19*a* is attached to the bearing supports 15*a* of the soft lower roll 11 in the first module $M_1$ and, in a corresponding way, the second guide roll 29 is attached to the bearing supports 25*a* of the first soft roll 21 in the second module $M_2$.

FIGS. 1A and 1B show only one side of the calender, and it is understood that the second set of equipment, corresponding to those shown in the figure, is placed at the other side of the calender, i.e. bearing supports of the rolls, support arms, and hydraulic cylinders are, of course, provided both at the driving side and at the operating side of the calender.

FIG. 1B shows the calender in the mode of operation in which the nips have been opened for threading of the web. In such a case, the soft lower rolls 11 and 12 in the first module $M_1$ have been pivoted to the respective lower positions 11' and 12'. In a corresponding way, the soft upper rolls 21 and 22 in the second module $M_2$ have been pivoted to the respective upper positions 21',22'. Said shifting of the soft rolls takes place by means of said pivot arms and hydraulic cylinders 18*a*,18*b* and 28*a*,28*b* coupled with the pivot arms, the arms being pivoted by means of said cylinders to the positions 16*a*',16*b*'and 26*a*',26*b*' in FIG. 1B.

As is seen from FIG. 1B a horizontally fully free space and path is immediately opened through the calender, through which path the leader cut from the web can be passed as a straight run fast and free of disturbance. In FIG. 1B, the threading of the leader through the calender is represented by the dotted-dashed line $S_{in}$–$S_{out}$. During threading, the leader S is guided by means of air in blowing direction B, shown schematically in FIG. 1B. In addition to, or instead of, the air blowings, it is possible to employ prior-art threading rope systems, which, as devices known commonly in the prior art, are not shown in the figures.

After the narrow leader has been passed through both of the modules $M_1$,$M_2$ in the calender in the way shown in FIG. 1B, the calendering nips are closed by means of the hydraulic cylinders 18*a*,18*b* and 28*a*,28*b*, whereupon the web W is spread to full width and the nips are loaded by means of said hydraulic cylinders to the linear load required by the calendering.

As is well known, soft rolls are more sensitive to damage than hard rolls. In the invention, the soft rolls 11,12 and 21,22 can be replaced even while the calender is running by shifting the damaged soft roll concerned to the position shown in FIG. 1B, whereby, when matt qualities are being run, the web coming out of the paper machine does not go to broke completely. Upon replacement of the damaged roll the calender is restored to normal operation.

FIG. 2 shows a calender in which each calender module $M_1$ and $M_2$ comprises a hard roll 10,20, which is mounted fixed, and three soft rolls 11,12,13;21,22,23. In FIG. 2, said rolls are illustrated by dashed lines in the positions 11',12',13' and 21',22',23' respectively in which the nips $N_{11}$,$N_{12}$,$N_{13}$ and $N_{21}$,$N_{22}$,$N_{23}$ have been opened, whereby, in the horizontal plane $H_1$–$H_1$, a free space is opened for straight passing of the leader S in the way described above in connection with FIG. 1B.

In FIG. 2, the soft rolls 11,12 and 21,22 may be attached respectively to arms 16*a*,16*b*;27*a*,27*b* similar to those shown in FIGS. 1A and 1B, which are loaded and pivoted by hydraulic cylinders 18*a*,18*b*;28*a*,28*b*. As soft rolls 13 and 23 are placed in the middle, such a variable-crown roll may be used as it has no loading arm and in which the roll mantle can be displaced in relation to its central axle to open the nips $N_{12}$,$N_{22}$ so as to shift the roll mantle from the position 13 to the position 13' and from the position 23 to the position 23', respectively. Said variable-crown roll is manufactured and marketed by the applicant under the trade mark "SYM-ROLL Z".

As is shown in FIG. 2, each of the calender modules $M_1$,$M_2$ includes three nips $N_{11}$,$N_{12}$,$N_{13}$;$N_{21}$,$N_{22}$,$N_{23}$, which are placed, in connection with the first hard roll 10, on the lower half of the circumference of the roll and, in a corresponding way, in connection with the second hard roll 20, on the upper half of the circumference of the roll.

FIG. 3 shows such a calender module M applicable in the invention in which, differing from the above, the soft rolls 11 and 12 are mounted fixed and the hard roll 10 is arranged as displaceable vertically by means of loading arms or equivalent between the positions 10 and 10', which shifting is represented by the arrows A. FIG. 3 is a schematic illustration of the guide roll 31, which also guides the web $W_{in}$–$W_{out}$ and which is arranged displaceable along with the hard upper roll 10 between the positions 31 and 31'. The module M as shown in FIG. 3 can also be inverted, so that the displaceable hard roll 10 is a lower roll and the fixed soft rolls 11,12 are upper rolls, in the other respects similar to the second module $M_2$ shown in FIG. 1A.

In FIG. 3, a band loop 30 is illustrated by a dashed line, said loop passing around the soft rolls 11 and 12 and protecting the coating on the soft rolls or, if necessary, forming the soft coating required in calendering nips, so that the rolls 11 and 12 may be even hard-faced rolls. Said band loop is advantageous in the respect that, when it is worn out or broken, it can be replaced quickly without needing to replace the calender rolls 11,12. If necessary, said band loop 30 may be employed in one or several calender modules $M_1$,$M_2$ . . . $M_N$, wherein N is the number of subsequent calender modules.

In some particular applications, the geometries of location of rolls described above and the threading can also be accomplished so that, instead of the hard rolls 10 and 20, soft rolls or rolls placed and operating in a corresponding way are used, in which case some or all of the nips in one, two or more subsequent modules in a calender are "twosidedly" soft nips.

An on-line soft calender has been described above in which the main direction of the web W is substantially horizontal as it runs through the calender, in which case a straight threading is particularly advantageous. In some special applications, e.g. when the space available for the calender in modernizations is very small, a calender in accordance with the invention may also be accomplished as a vertical version, for example, so that the horizontal frame 40 shown in FIGS. 1A and 1B has been rotated to the vertical position, in which case the threading becomes substantially vertical. In such a case, before and after the calender, paper guide rolls are needed, so that the threading cannot be made completely straight. Also, in some special applications, a construction with various diagonal draws between the vertical version described above and the horizontal versions shown in the figures may be possible. Said particular versions are not equally advantageous as the optimal embodiment of the invention, which is the horizontal version shown in the figures, wherein the simple straight threading is accomplished.

In the following claims, the various details of the invention may vary but will remain within the scope of the invention defined herein and differ from the details described above by way of example only.

We claim:

1. A device for on-line calendering a paper web as it originates from a machine, said device having an open position for threading said web and a closed position for calendering said web, said device comprising:

a first soft calender module comprising a first soft calendering roll being placed adjacent said machine, said first soft calendering roll being positioned spaced from said web when said device is placed in the open position, and abutting said web when said device is placed in the closed position; a first counter-roll positioned downstream from said first soft calendering roll, said first counter-roll being spaced a distance away from and avoiding surface-to-surface contact with said first soft calendering roll when said device is placed in the open position, and abutting said first soft calendering roll to create a first nip therebetween through which said web is passed when said device is placed in the closed position; a second soft calendering roll positioned downstream from said first counter-roll, said second soft calendering roll being spaced a distance away from and avoiding surface-to-surface contact with said first counter-roll when said device is placed in the open position, and abutting said first counter-roll to create a second nip therebetween through which said web is passed when said device is placed in the closed position;

a second soft calender module spaced from said first calender module comprising a third soft calendering roll disposed downstream from said second soft calendering roll, said third soft calendering roll being positioned spaced from said web when said device is placed in the open position, and abutting said web when said device is placed in the closed position; a second counter-roll disposed downstream from said third calendering roll, said second counter-roll being spaced a distance away from and avoiding surface-to-surface contact with said third soft calendering roll when said device is placed in the open position, and abutting said third soft calendering roll to create a third nip therebetween through which said web is passed when said device is placed in the closed position; a fourth soft calendering roll disposed downstream from said second counter-roll, said fourth soft calendering roll being spaced a distance away from and avoiding surface-to-surface contact with said second counter-roll when said device is placed in the open position, and abutting said second counter-roll to create a fourth nip therebetween through which said web is passed when said device is placed in the closed position; and means for displacing said rolls to create said open and closed positions, wherein in said open position a substantially horizontal, continuously straight, free passage is created between the nips for threading said web in a substantially straight run through said device, and for independently loading said nips in said closed position when the web is passed between said nips.

2. The device of claim 1, comprising at least two calender modules placed in a sequence such that the counter-roll of every other module is positioned on the side of the web opposite the counter-roll of its immediately preceding module.

3. The device of claim 1, further comprising air jets for directing the passage of said web.

4. The device of claim 1, further comprising threading ropes for threading said web in said open position.

5. The device of claim 1, wherein at least one of said counter-rolls is a hard-faced roll.

6. The device of claim 5, wherein said hard-faced roll is a steel roll.

7. The device of claim 1, wherein said means for displacing said rolls comprises, a stationary bearing support means for supporting each of said counter-rolls, and actuatable support arm means for moving said calendering rolls, said support arm means being attached to each of said calendering rolls, so that in said open position, said calendering rolls are shifted a distance away from said counter-rolls, and in said closed position said calendering rolls are loaded against said counter-rolls.

8. The device of claim 1, wherein said means for displacing said rolls comprises displacement means for said counter-roll and fixed means for said calendering rolls.

9. The device of claim 1, further comprising an elastic belt means in at least one of said modules for forming a coating on said calendering rolls, said elastic belt means being positioned around the calendering rolls of at least one of said calender modules and passing through each of said nips, so as to create calendering roll-elastic belt means-web-counter-roll sandwiches therein.

10. The device of claim 1, wherein at least one of said counter-rolls possesses an axis of rotation, said axis resides in a vertical plane, and said calendering rolls are substantially symmetrically placed on either side of said vertical plane.

11. The device of claim 1, wherein said calendering rolls are positioned in a manner so as to allow replacement during operation of the device.

12. The device of claim 1, wherein all of said rolls are soft rolls.

13. The device of claim 1, further comprising a paper guide roll positioned upstream from said third calendering roll for receiving said web.

14. A device, for calendering a paper web as it originates from a machine, said device having an open position for threading said web and a closed position for calendering said web, said device comprising:

a first calendering roll being placed adjacent said machine, said first calendering roll being positioned near said web when said device is placed in the open position, and abutting said web when said device is placed in the closed position;

a counter-roll being positioned downstream from said first calendering roll, said counter-roll being spaced a distance away from and avoiding surface-to-surface contact with said first calendering roll when said device is placed in the open position, and abutting said first calendering roll to create a first nip therebetween through which said web is passed when said device is placed in the closed position;

a second calendering roll being positioned downstream from said counter-roll, said second calendering roll being spaced a distance away from and avoiding surface-to-surface contact with said counter-roll when said device is placed in the open position, and abutting said counter-roll to create a second nip therebetween through which said web is passed when said device is placed in the closed position;

a third calendering roll positioned between said first and second calendering rolls, said third calendering roll being spaced a distance away from, and avoiding surface-to-surface contact with said counter-roll when said device is placed in the open position, and abutting said counter-roll to create a third nip therebetween through which said web is passed when said device is placed in the closed position; and means for displacing said rolls to create said open and closed positions, wherein in said open position a substantially horizontal, continuously straight, free passage is created between the nips for threading said web in a substantially straight run, and in said closed position the web is passed between said nips by said rolls.

15. The device of claim 14, wherein said counter-roll further possesses an axis of rotation, said axis resides in a vertical plane, and said third calender roll is positioned in said vertical plane.

16. The device of claim 14, wherein said counter-roll further possesses an axis of rotation, said axis resides in a vertical plane, and said third calender roll is positioned in proximity to said vertical plane.

17. The device of claim 14, wherein said third calendering roll is a variable-crown roll and said means for displacing said rolls includes support arms attached to said first and second calendering rolls, and further comprising roll mantle means for engaging said third calendering roll and shifting said third calendering roll between said open and closed positions.

18. The device of claim 14, further comprising a paper guide roll positioned upstream from said second calender roll for receiving said web.

19. The device of claim 14, wherein said means for displacing said rolls comprises displacement means for said counter-roll and fixed means for said calendering rolls.

20. The device of claim 14, further comprising an elastic belt means for forming a coating on said calendering rolls, said elastic belt means being positioned around the calendering rolls and passing through each of said nips, so as to create calendering roll-elastic belt means-web-counter-roll sandwiches therein.

21. The device of claim 14, wherein said calendering rolls are positioned in a manner so as to allow replacement of said calendering rolls during operation of said device.

* * * * *